US008766963B2

(12) United States Patent
Lee et al.

(10) Patent No.: US 8,766,963 B2
(45) Date of Patent: Jul. 1, 2014

(54) ORGANIC LIGHT EMITTING DIODE DISPLAY

(75) Inventors: Ho-Young Lee, Paju-si (KR); Nam-Kil Park, Puju-si (KR)

(73) Assignee: LG Display Co., Ltd., Seoul (KR)

( * ) Notice: Subject to any disclaimer, the term of this patent is extended or adjusted under 35 U.S.C. 154(b) by 685 days.

(21) Appl. No.: 12/982,068

(22) Filed: Dec. 30, 2010

(65) Prior Publication Data

US 2011/0157135 A1 Jun. 30, 2011

(30) Foreign Application Priority Data

Dec. 31, 2009 (KR) ..... 10-2009-0135685

(51) Int. Cl.
*G09G 5/00* (2006.01)
*G06F 3/038* (2013.01)

(52) U.S. Cl.
USPC ..... 345/211; 345/76; 345/77; 345/80; 345/204; 257/2; 257/40; 257/59

(58) Field of Classification Search
None
See application file for complete search history.

(56) References Cited

U.S. PATENT DOCUMENTS

2004/0109100 A1* 6/2004 Park et al. ..... 349/40
2007/0075937 A1* 4/2007 Kim ..... 345/76
2008/0158114 A1* 7/2008 Kim ..... 345/77
2009/0225013 A1* 9/2009 Lee et al. ..... 345/80
2010/0033409 A1* 2/2010 Park ..... 345/76
2010/0188391 A1* 7/2010 Kim ..... 345/212

FOREIGN PATENT DOCUMENTS

KR 100666640 B1 1/2007

OTHER PUBLICATIONS

Office Action issued in corresponding Korean Patent Application No. 10-2009-0135685, mailed May 29, 2013, 3 pages.

* cited by examiner

*Primary Examiner* — Jesus Hernandez
(74) *Attorney, Agent, or Firm* — Brinks Gilson & Lione

(57) ABSTRACT

An OLED display device for improving a contrast ratio is disclosed. The OLED display device includes a pixel circuit, wherein the pixel circuit includes a driving transistor driving the light emitting device, a first switching transistor supplying a data voltage from a data line to a first node in response to a first scan signal from a first scan line, a second switching transistor connecting the driving transistor to a power line in a diode structure in response to the first scan signal from the first scan line, a third switching transistor supplying a reference voltage from a reference voltage supply line to the first node in response to a light emission control signal from a light emission control line, a fourth switching transistor connecting the driving transistor to the light emitting device in response to the light emission control signal from the light emission control line, a fifth switching transistor connecting the fourth switching transistor to the reference voltage supply line in response to a second scan signal from the second scan line, a storage capacitor connected between the first node and a second node connected to a gate electrode of the driving transistor, and a boost capacitor connected to the first scan line and the second node.

4 Claims, 4 Drawing Sheets

ORGANIC LIGHT EMITTING DIODE DISPLAY

This application claims the benefit of the Korean Patent Application No. 10-2009-0135685, filed in Korea on Dec. 31, 2009, which are hereby incorporated by reference as if fully set forth herein.

BACKGROUND

1. Field of the Invention

The present disclosure relates to organic light emitting diode display devices, and more particularly to an organic light emitting diode display device which can compensates for variation of characteristics of driving transistors and make time division driving of data lines.

2. Discussion of the Related Art

The OLED display device is a self light emitting device which emits a light as an electron and a hole of an organic light emitting layer therein re-couples and is expected to be the next generation display device owing to high brightness, a low driving voltage and possibility of fabrication of an extra-thin device.

Each of a plurality of pixels of the OLED display device is provided with a light emitting device having an organic light emitting layer between an anode and a cathode, and a pixel circuit for driving the light emitting device, independently. The pixel circuit is provided with a switching transistor, a capacitor, and a driving transistor, principally. The switching transistor charges a data signal to the capacitor in response to a scan pulse, and the driving transistor controls current intensity to be supplied to the light emitting device according to a data voltage charged to the capacitor for producing a gray scale.

Related art OLED display devices have the disadvantage that a non-uniform threshold voltage of the driving transistor coming from process variation causes non-uniform brightness, and variation of the threshold voltage with a time leads to brightness reduction, resulting in a reduced lifetime. In order to solve this problem, as a method for correcting the threshold voltage of the driving transistor, a method has been suggested, in which the threshold voltage of the driving transistor is sampled by using a reference voltage, and an actual data voltage is supplied to correct mobility together with the threshold voltage of the driving transistor.

However, this method has a problem in that, as the OLED display device becomes to have high definition and large sized, a time period for sampling the threshold voltage of the driving transistor becomes inadequate, leading the driving voltage of the driving transistor to rise which drops a contrast ratio. The method also has a problem in that, as the OLED display device becomes to have high definition and large sized, if a multiplexer is applied for the time division driving of the data lines, since the data line is floated in the time period for sampling the threshold voltage of the driving transistor, causing charge sharing of a parasitic capacitor of the date line and a storage capacitor increasing the driving voltage of the driving transistor and a current to the OLED, black brightness increases, to drop the contrast ratio.

BRIEF SUMMARY

An OLED display device includes a light emitting device, and a plurality of pixels each having a pixel circuit for driving the light emitting device, wherein the pixel circuit includes a driving transistor for driving the light emitting device, a first switching transistor for supplying a data voltage from a data line to a first node in response to a first scan signal from a first scan line, a second switching transistor for connecting the driving transistor to a power line in a diode structure in response to the first scan signal from the first scan line, a third switching transistor for supplying a reference voltage from a reference voltage supply line to the first node in response to a light emission control signal from a light emission control line, a fourth switching transistor for connecting the driving transistor to the light emitting device in response to the light emission control signal from the light emission control line, a fifth switching transistor for connecting the fourth switching transistor to the reference voltage supply line in response to a second scan signal from the second scan line, a storage capacitor connected between the first node and a second node connected to a gate electrode of the driving transistor for having a differential voltage of the first and second nodes charged thereto and maintaining thereby, and a boost capacitor connected to the first scan line and the second node, for boosting a voltage at the second node in response to a variation amount of the first scan signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION OF THE DRAWINGS AND THE PRESENTLY PREFERRED EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
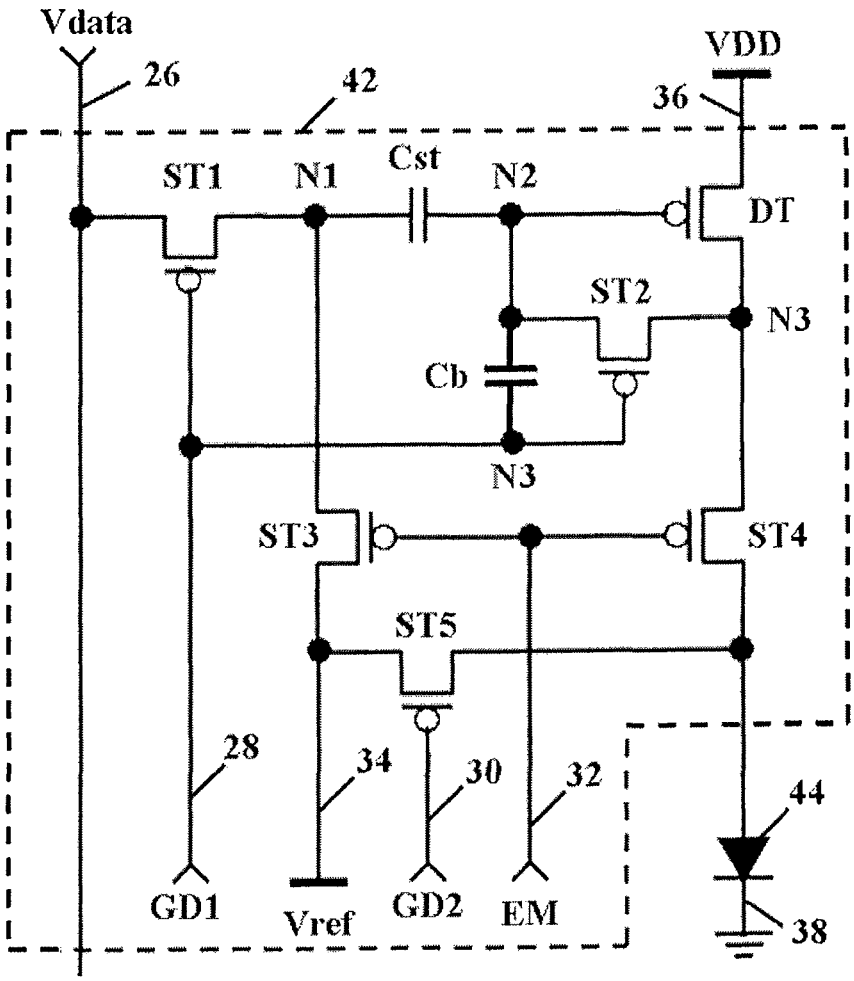
FIG. 1 illustrates a pixel circuit diagram in accordance with a preferred embodiment of the present invention.
Figure 2:
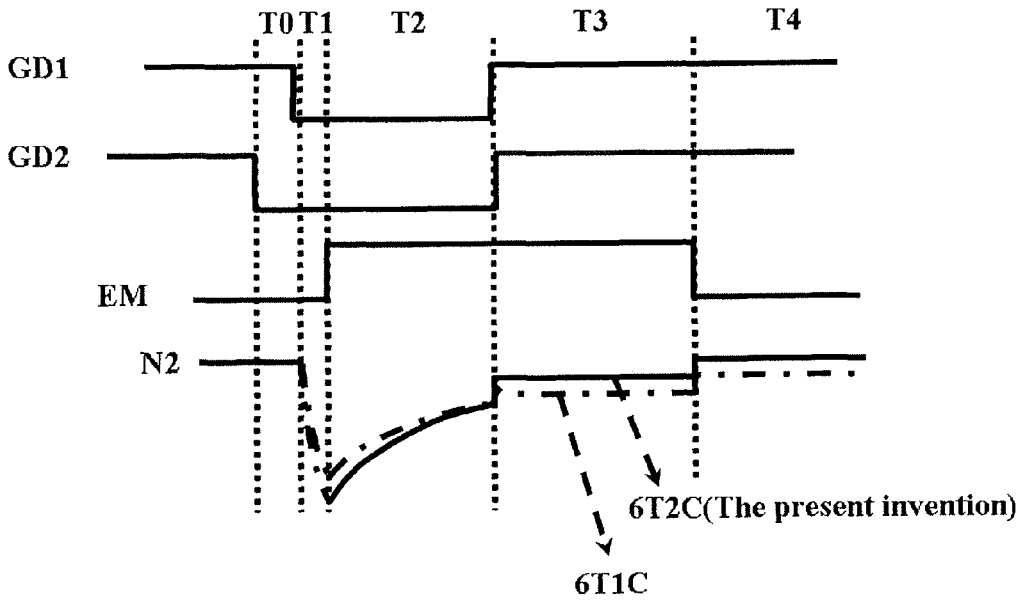
FIG. 2 illustrates driving wave forms of the pixel circuit in FIG. 1.

FIG. 1 illustrates a circuit diagram of one pixel in an OLED display device in accordance with a first preferred embodiment of the present invention, and FIG. 2 illustrates driving wave forms of the pixel in FIG. 1.

Referring to FIG. 1, the pixel has a pixel circuit 42 for driving a light emitting device 44, independently. The light emitting device 44 includes an anode connected to the pixel circuit 42, a cathode connected to a ground line, and an OLED having an organic light emitting layer between the anode and the cathode. The pixel circuit 42 has a driving transistor DT, first to fifth switching transistors ST1 to ST5, a storage capacitor Cst and a boost capacitor Cb. Thought all of the driving transistor DT and the first to fourth switching transistors ST1 to ST4 are PMOS transistors, NMOS transistors may also be used.

The first switching transistor ST1 had a gate electrode connected to a first scan line 28, and a source electrode and a drain electrode connected between a data line 26 and a first node N1. The second switching transistor ST2 has a gate electrode connected to the first scan line 28, and a source electrode and a drain electrode connected between a second node N2 and a third node N3. The third switching transistor ST3 has a gate electrode connected to a light emission control line 32, and a source electrode and a drain electrode connected between the first node N1 and a reference voltage supply line 34. The fourth switching transistor ST4 has a gate electrode connected to the light emission control line 32, and a source electrode and a drain electrode connected between the third node N3 and an anode of the light emitting device 44. The fifth switching transistor ST5 has a gate electrode connected to a second scan line 30, and a source electrode and a drain electrode connected between the reference voltage supply line 34 and a drain electrode of the fourth switching transistor ST4. The driving transistor DT has a gate electrode connected to the second node N2 and a source electrode and a drain electrode connected between a power supply line 36 and the third node N3. The storage capacitor Cst is connected between the first node N1 and the second node N2, the boost capacitor Cb connected between the second node N2 and the third node N3. The source electrode and the drain electrode in each of the driving transistors DT and the first to fifth switching transistors ST1 to ST5 are interchangeable according to a current direction.

The first switching transistor ST1 supplies a data voltage Vdata from the data line 26 to the first node N1 in an initializing period T1 and a sampling period T2 shown in FIG. 2 in response to a first scan signal GD1 from the first scan line 28.

The second switching transistor ST2 is used as a path together with the first switching transistor ST1 for initializing a gate electrode of the driving transistor DT, i.e., the second node N2, in the initializing period T1 in response to the first scan signal GD1 from the first scan line 28. The second switching transistor ST2 is used as a path for short circuiting the gate electrode and the drain electrode of the driving transistor DT for sampling a driving voltage VDD and a threshold voltage Vth of the driving voltage DT in the sampling period T2.

The third switching transistor ST3 supplies the reference voltage Vref to the first node N1 in a pre-initializing period T0 before the initializing period T1, in which the first switching transistor T1 is turned on, in response to a light emitting control signal EM from the light emitting control line 32.

The fourth switching transistor ST4 is used as a path together with the first switching transistor ST2 for pre-initializing a drain electrode of the driving transistor DT, in the pre-initializing period T0 before the initializing period T1, in which the second switching transistor ST2 is turned on, in response to the light emitting control signal EM from then light emitting control line 32. The fourth switching transistor ST4 is used as a path for initializing the first node N1 together with the second switching transistor T2 in the initializing period T1. The fourth switching transistor ST4 supplies an output current I from the driving transistor DT to the light emitting device 44 in the light emitting period T4.

The fifth switching transistor ST3 is used as a path for pre-initializing the anode of the drain electrode of the driving transistor DT and the anode of the light emitting device 44 in the pre-initializing period T0 together with the fourth switching transistor ST4 in response to a second scan signal GD2 from the second scan line 30. The fifth switching transistor ST3 is used as a path for initializing the first node N1 in the initializing period together with then second switching transistor T2.

The storage capacitor Cst has a differential voltage of the first node N1 and the second node N2 charged thereto and maintained thereby for driving the driving transistor DT in a boosting period T3 and the light emitting period T4.

The boost capacitor Cb serves to boost a voltage at the second node N2 in the boosting period T3 in response to a varying voltage ΔVg1 of the first scan signal GD1 from the first scan line 28, i.e., a rising voltage. Eventually, even if a second node N2 voltage is dropped due to insufficiency of the sampling period T2 of the driving transistor DT or due to drop of the data voltage Vdata caused by coupling action of a floated data line 26 and the storage capacitor Cst at the time of time division driving, the boost capacitor Cb compensates for a dropped portion of the second node N2 voltage, suppressing boosting of the voltage Vgs of the driving transistor DT, thereby preventing the black brightness from rising.

The operation of the pixel circuit 42 in FIG. 1 will be described in detail with reference to the driving wave forms shown in FIG. 2. The switching transistors ST1 to ST5 and the driving transistor DT, being PMOS transistors, are turned on and activated at a low level.

In the pre-initializing period T0, the fifth switching transistor ST5 is turned on in response to the second scan signal GD2 which is falling to a low state, the third and fourth switching transistors ST3 and ST4 are used as paths in response to the light emitting control signal EM which has been maintained the low state, and the first and second switching transistors ST1 and ST2 are maintained turn off states in response to the first scan signal GD1 which has been maintained a high state. According to this, the drain electrode of the driving transistor DT and the anode voltage of the light emitting device 44 are pre-initialized toward the reference voltage Vref via the fourth and fifth transistors ST4 and ST5 turned on thus.

In the initializing period T1, the first and second switching transistors ST1 and ST2 are turned on in response to the first scan signal GD1 which is falling to a low state, and the third to fifth switching transistors ST3 to ST5 have been turned on in response to the second scan signal GD2 which has been maintained the low state and the light emitting control signal EM. According to this, a gate voltage of the driving transistor DT, i.e., the second node N2 voltage, is initialized toward the reference voltage Vref via the second, fourth, fifth switching transistors ST2, ST4 and ST5 turned on thus. In this instance, since the fifth switching transistor ST5 turned on thus prevents a current from flowing to the light emitting device 44, thereby suppressing the black brightness from increasing due to emission of a light from the light emitting device 44 in the initializing period T1. And, since the data voltage Vdata is supplied from the data line 26 to the first node N1 through the first switching transistor ST1 turned on thus and the reference voltage Vref is supplied to the first node N1 through the third switching transistor ST3 turned on thus, a sum voltage Vdata+Vref of the data voltage Vdata and the reference voltage Vref is supplied to the first node N1.

In the sampling period T2, the third and fourth switching transistors ST3 and ST4 are turned off in response to the light emitting signal EM which is rising to a high state, and the first, second, and fifth switching transistors ST1, ST2 and ST5 have been maintained turn on states in response to the first and second scan signals GD1 and GD2 which have been maintained low states. According to this, the driving transistor DT activated into a diode structure through the second switching transistor ST2 turned on thus samples a differential voltage VDD-Vth of the driving voltage VDD and the threshold voltage Vth, and supplies the differential voltage to the second node N2. In this instance, as the sampling voltage VDD-Vth at the second node N2 increases gradually, a voltage at the second node N2 increases gradually as shown in FIG. 2, if the sampling is finished, the second node N2 voltage maintains a differential voltage {(VDD−Vth)−(Vdata+Vref)} of the voltage VDD-Vth sampled by the driving transistor DT and the first node N1 voltage Vdata+Vref. The fifth switching transistor ST5 turned on in the sampling period T2 supplies the reference voltage Vref to the anode of the light emitting device 44 to prevent the light emitting device 44 from emitting a light in the sampling period T2.

In the boosting period T3, the first, second and fifth switching transistors ST1, ST2 and ST5 are turned off by the first and second scan signals GD1 and GD2 which are rising to high states, and the third and fourth switching transistors ST3 and ST4 have been maintained turned off states by the light emitting control signal EM which has been maintained a high state. According to this, since the second node N2 is floated by the second switching transistor ST2 turned off thus and the first scan signal GD1 being supplied to the third node N3 is boosting, the second node N2 voltage boosts according to a varied portion ΔV of the first scan signal GD1. In this instance, a boosting voltage VB at the second node N2 is fixed by a combined ratio {Cb/(Cb+Cst)} of the boost capacitor Cb and the storage capacitor Cst and the varied portion ΔV of the first scan signal GD1 as shown in the following equation 1.

$$VB = \left(\frac{Cb}{Cb + Cst}\right) \times \Delta V \tag{1}$$

According to this, the second node N2 voltage Vn2 in the boosting period T3 increases by a voltage VB boosted by the boost capacitor Cb as shown in the following equation 2.

$$\begin{aligned} Vn2 &= (VDD - Vth) - (Vdata + Vref) + \left(\frac{Cb}{Cb + Cst}\right) \times \Delta V \\ &= (VDD - Vth) - (Vdata + Vref) + VB \end{aligned} \tag{2}$$

Referring to FIG. 2, it can be known that the second node N2 voltage is increased at the pixel circuit 42 of the present invention of a 6T2C structure with the boost capacitor Cb in comparison to the second node N2 voltage at the pixel circuit of a 6T1C structure having no boost capacitor Cb. Accordingly, an output current I from the driving transistor DT in the boosting period T3 can be as the following equation 3.

$$\begin{aligned} I &= k(Vgs - Vth)^2 \\ &= k[VDD - \{(VDD - Vth) - (Vdata + Vref) + VB\} - Vth]^2 \\ &= k(Vdata - Vref - VB)^2 \end{aligned} \tag{3}$$

Where, $$k = \frac{1}{2}\mu Cox \frac{W}{L},$$

$$VB = \left(\frac{Cb}{Cb + Cst}\right) \times \Delta V$$

In the light emitting period T4, since the third and fourth switching transistors ST3 and ST4 are turned on by the light emitting control signal EM which is falling to a low state, supplying the output current I from the driving transistor DT to the light emitting device 44, the light emitting device 44 emits the light in proportion to the supplied current I.

Referring to equation 3, as there are canceled items of the driving voltage VDD and the threshold voltage Vth in voltages that fix the output current I from the driving transistor DT, the output current I can prevent variation of the driving voltage VDD caused by voltage drop of the power supply line 36 and the output current I from becoming non-uniform caused by variation of the threshold voltage Vth of the driving transistor DT. And, referring to equation 3, the voltage which fixes the output current I of the driving transistor DT is fixed by the data voltage Vdata—the reference voltage Vref-boosting voltage VB. Accordingly, even if the second node N2 voltage is reduced due to the insufficiency of the sampling period T2 of the driving transistor DT or the data voltage Vdata is reduced to reduce the second node N2 voltage due to the coupling action of the floated data line 26 and the storage capacitor Cst at the time of the time division driving, since the boosting voltage VB by the boost capacitor Cb compensates for an insufficient portion of the second node N2 voltage to suppress boosting of the voltage Vgs of the driving transistor DT, the increase of the black brightness can be prevented.

Thus, even if the sampling period T2 is insufficient, or the data voltage Vdata is reduced due to the coupling action of the floated data line 26 and the storage capacitor Cst at the time of the time division driving, the pixel circuit of the OLED display device can suppress boosting of the driving voltage DT voltage Vgs by compensating the boosted voltage VB by the boost capacitor Cb for the insufficient voltage at the second node N2, thereby suppressing the increasing of the black brightness.

Figure 3:
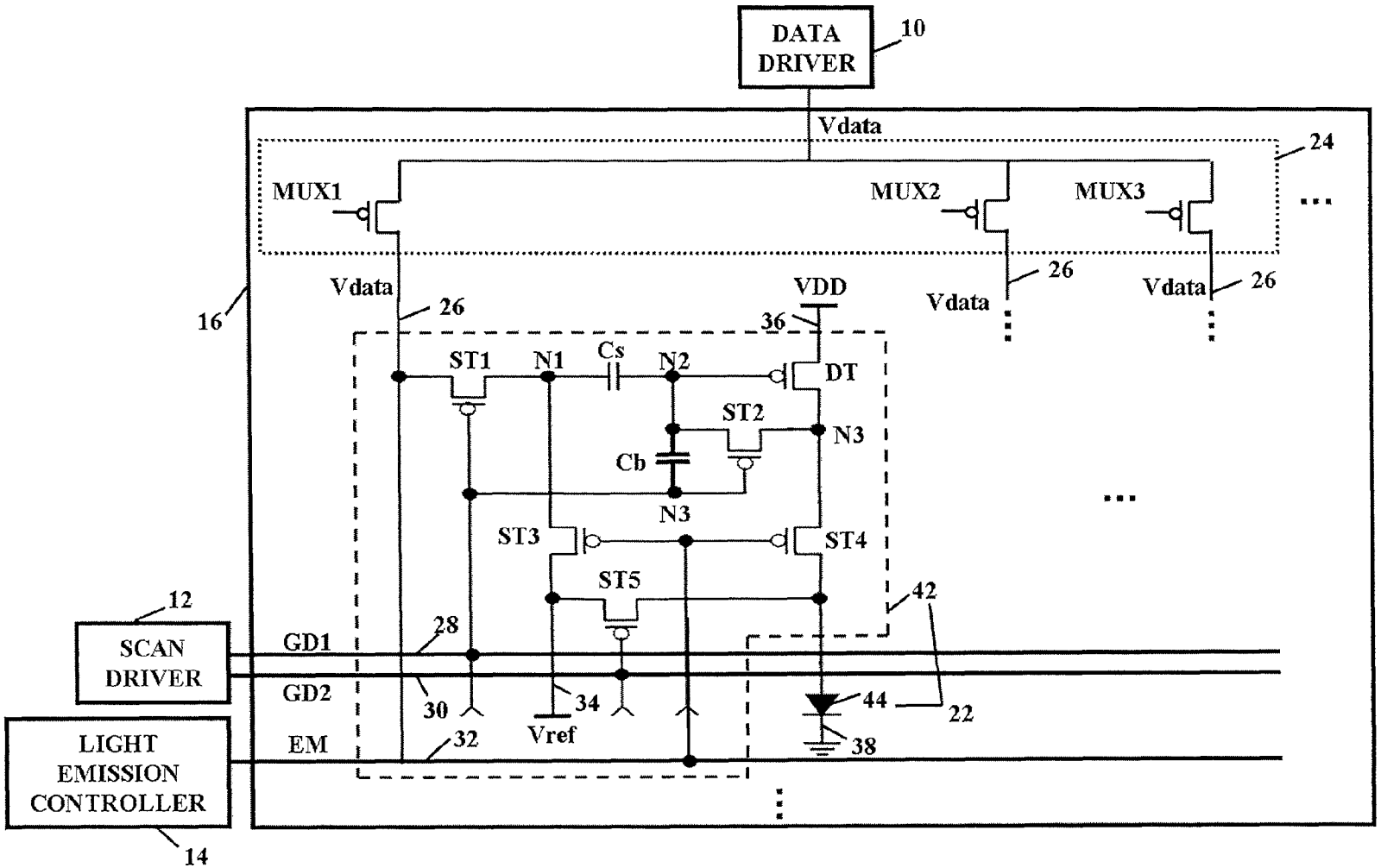
FIG. 3 illustrates a circuit diagram of an OLED display device with the pixel circuit in FIG. 1, schematically.
Figure 4:
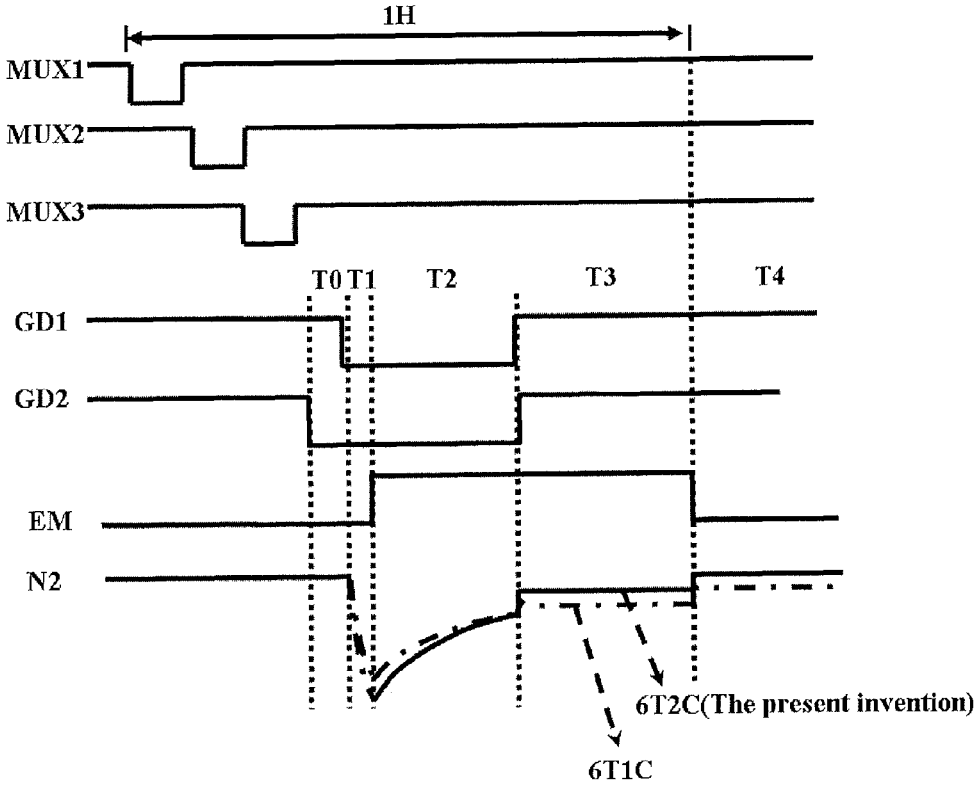
FIG. 4 illustrates driving wave forms of the image display unit in FIG. 3.

FIG. 3 illustrates a circuit diagram of an OLED display device with the pixel circuit in FIG. 1 schematically, and FIG. 4 illustrates driving wave forms of the image display unit in FIG. 3.

Referring to FIG. 3, the OLED display device includes a picture display unit 16, a data driver 10 for driving the picture display unit 16, a scan driver 12, and a light emitting controller 14.

The picture display unit 16 includes a matrix of pixels 22, data lines 26 each for supplying a data signal DS from the data driver 10 to the pixels 22, first and second scan lines 28 and 30 for supplying first and second scan signals GD1 and GD2 from the scan driver 12 to the pixels 22, and a light emission control line 32 for supplying a light emission control signal EM from the light emission controller 14 to the pixels 22. The picture display unit 20 includes a reference voltage line 34 for supplying the reference voltage Vref to the pixels 22, a power source line 36 for supplying a driving power VDD, and a ground line 38 for supplying a ground voltage. The picture display unit 20 also includes a plurality of multiplexers 24 connected to the data driver 10 and the data line 26 for making time division driving of the plurality of data lines 26. For convenience's sake, FIG. 1 illustrates only one of the multiplexers 24. Each of the pixels 22 includes a light emitting device 44, a pixel circuit 42 for driving the light emitting device 44 independently. As shown in FIG. 1, the pixel circuit 42 has a 6T2C structure including the driving transistor DT, first to fifth switching transistor ST1 to ST5, a storage capacitor Cst and a boost capacitor Cb.

The scan driver 12 supplies a first scan signal GD1 to the first scan line 28, and a second scan signal GD2 to the second scan line 30. The light emission controller 14 supplies the light emission control signal EM to the light emission control line 32. The scan driver 12 drives the first and second scan lines GD1 and GD2 in a relevant scan period 1H shown in FIG. 4, and the light emission controller 14 drives the light emission control line 32 in a next light emission period T4 until before the scan period of a next frame.

The data driver 10 converts a digital data into an analog data and forwards the analog data. Particularly, the data driver 10 supplies a plurality of data signals DS for the plurality of data lines 26 connected to the multiplexers 24 in succession through relevant output channels.

Each of the multiplexers 24 has a plurality of switches S1, S2 and S3 for making time division driving of the plurality of data lines 26 in response to a control signal MUX1, MUX2 or MUX3. The switches S1, S2 and S3 of each of the multiplexers 24 are connected to one output channel of the data driver 10 in common, for supplying the data voltage Vdata being supplied through the one output channel to the plurality of data lines 26 in succession in response to the control signal MUX1, MUX2, MUX3 having phases shifted in succession, respectively. Since the multiplexers 24 are turned off after supplying the data voltage Vdata to the plurality of data lines 26 in succession, the plurality of data lines 26 are floated while maintaining the data voltage supplied thus.

As described in FIGS. 1 and 2, the pixel circuit 42 initializes the second node N2 in the pre-initializing period T0 and the initializing period T1 in response to the first and second scan signals GD1 and GD2, samples the differential voltage VDD-Vth of the driving voltage VDD and the threshold voltage Vth in the sampling period T3, and boosts the second node N2 voltage by the boost capacitor Cb in the boosting period T3. According to this, even if the second node N2 voltage is reduced due to the insufficiency of the sampling period T2 of the driving transistor DT or the data voltage Vdata is reduced to reduce the second node N2 voltage due to the coupling action of the floated data line 26 and the storage capacitor Cst at the time of the time division driving, since the boosting voltage VB by the boost capacitor Cb compensates for an insufficient portion of the second node N2 voltage to suppress boosting of the voltage Vgs of the driving transistor DT, the increase of the black brightness can be prevented. And, the supply of the output current I of the driving transistor DT fixed according to the equation 3 to the light emitting device 44 enable the light emitting device to emit a light in proportion to the supply current I.

As has been described, the OLED display device of the present invention has the following advantages.

The provision of the boost capacitor permits to compensate a boosted voltage by the boost capacitor for an insufficient voltage at the second node even if the data voltage is reduced due to insufficient sampling period or coupling of a floated data line and the storage capacitor at the time of time division driving to suppress voltage boosting of the driving transistor to prevent the black brightness from boosting, thereby improving a contrast ratio.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. An OLED display device comprising:

a plurality of pixels each having a light emitting device and a pixel circuit for driving the light emitting device, wherein the pixel circuit includes;

a driving transistor for driving the light emitting device, a first switching transistor for supplying a data voltage from a data line to a first node in response to a first scan signal from a first scan line, a second switching transistor for connecting the driving transistor to a power line in a diode structure in response to the first scan signal from the first scan line, a third switching transistor for supplying a reference voltage from a reference voltage supply line to the first node in response to a light emission control signal from a light emission control line, a fourth switching transistor for connecting the driving transistor to the light emitting device in response to the light emission control signal from the light emission control line, a fifth switching transistor for connecting the fourth switching transistor to the reference voltage supply line in response to a second scan signal from a second scan line, a storage capacitor connected between the first node and a second node connected to a gate electrode of the driving transistor for having a differential voltage of the first and second nodes charged thereto and maintaining thereby, and a boost capacitor connected to the first scan line and the second node, for boosting a voltage at the second node in response to a variation amount of the first scan signal, wherein:

a scan period in which the first and second scan signals are supplied includes an initializing period and a sampling period, the second node is initialized toward the reference voltage via the second, fourth, fifth switching transistors in the initializing period, and the first node has the data voltage and the reference voltage supplied thereto through the first and third switching transistors, the second node samples a differential voltage of the driving voltage from the power line and a threshold voltage of the driving transistor via the driving transistor and the second switching transistor in the sampling period, and in a boosting period in succession to the scan period, the second switching transistor is turned off, and the second node is boosted according to a variation amount of the first scan signal and a combined ratio {Cb/(Cb+Cst)} of the storage capacitor Cst and the boost capacitor Cb.

2. The OLED display device as claimed in claim 1, wherein the scan period further includes a pre-initializing period in which the second scan signal is driven before the first scan signal is driven such that the fifth switching transistor pre-initializes a connection point of the driving transistor connected through the fourth switching transistor and the light emitting device toward the reference voltage.

3. The OLED display device as claimed in claim 1, wherein the output current supplied to the light emitting device from the driving transistor is fixed by a differential voltage of the data voltage, the reference voltage, and a boosted voltage at the second node boosted in the boosting period.

4. The OLED display device as claimed in claim 1, further comprising a plurality of multiplexers for making time division driving of a plurality of data lines connected to a plurality of pixels.

* * * * *